US008857010B2

(12) United States Patent
Kim et al.

(10) Patent No.: US 8,857,010 B2
(45) **Date of Patent: *Oct. 14, 2014**

(54) VACUUM CLEANER HAVING SHREDDER

(71) Applicant: Samsung Electronics Co., Ltd., Suwon-si (KR)

(72) Inventors: Jang-keun Kim, Gwangju (KR); Kang Kim, Gwangju (KR); Chang-hyun Park, Gwanju (KR); Jae-jin Aum, Yongin-si (KR); Yong-jae Yong, Anyang-si (KR); Sung-cheol Lee, Seoul (KR); Jun-hwa Lee, Suwon-si (KR); Jun-hoo Choe, Gwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/889,728

(22) Filed: May 8, 2013

(65) Prior Publication Data

US 2013/0239358 A1 Sep. 19, 2013

Related U.S. Application Data

(63) Continuation-in-part of application No. 13/362,192, filed on Jan. 31, 2012, now Pat. No. 8,522,395.

(30) Foreign Application Priority Data

Jul. 4, 2011 (KR) ..... 10-2011-0066154
Jul. 4, 2012 (KR) ..... 10-2012-0072989

(51) Int. Cl.

| | |
|---|---|
| ***A47L 7/00*** | (2006.01) |
| ***A47L 7/02*** | (2006.01) |
| ***A47L 9/10*** | (2006.01) |
| ***A47L 9/16*** | (2006.01) |
| ***B02C 18/00*** | (2006.01) |

(52) U.S. Cl.
CPC .. *A47L 7/009* (2013.01); *A47L 7/02* (2013.01); *A47L 9/10* (2013.01); *A47L 7/0085* (2013.01); *A47L 9/106* (2013.01); *A47L 9/1683* (2013.01); *B02C 18/0007* (2013.01)
USPC ..... 15/339; 15/347; 15/353

(58) Field of Classification Search
CPC ..... A47L 7/0085; A47L 9/102; A47L 7/02; A47L 9/10
USPC ..... 15/339, 347, 353
IPC ..... A47L 7/00, 9/10
See application file for complete search history.

(56) References Cited

U.S. PATENT DOCUMENTS 2,105,803 A 1/1938 Barnes
3,968,938 A 7/1976 Ruhl et al.

(Continued)

FOREIGN PATENT DOCUMENTS

EP 1938735 7/2008
JP 2007-068728 3/2007

OTHER PUBLICATIONS

Extended European Search Report issued Oct. 17, 2012 in corresponding European Patent Application No. 12157911.4.

(Continued)

*Primary Examiner* — David Redding
(74) *Attorney, Agent, or Firm* — Staas & Halsey LLP

(57) ABSTRACT

A vacuum cleaner includes a cleaner body including a suction source configured to generate a suction force, a suction inlet body configured to inhale dust on a surface to be cleaned using the suction force of the suction source, a dust bucket detachably installed on the cleaner body, a cyclonic unit formed inside the dust bucket and configured to centrifuge the dust from air flowed in through the suction inlet body, and a paper-shredder installed on a top of the dust bucket and configured to communicate with the top of the dust bucket so that shredded pieces of paper are dropped inside a dust collecting space of the dust bucket.

20 Claims, 16 Drawing Sheets

(56) References Cited

U.S. PATENT DOCUMENTS

| | | | |
|---|---|---|---|
| 4,074,869 | A | 2/1978 | Johnson |
| 2005/0198770 | A1 | 9/2005 | Jung et al. |
| 2009/0144932 | A1 | 6/2009 | Yoo |

OTHER PUBLICATIONS

U.S. Office Action issued Jan. 23, 2013 in copending U.S. Appl. No. 13/362,192.

U.S. Notice of Allowance issued May 7, 2013 in copending U.S. Appl. No. 13/362,192.

VACUUM CLEANER HAVING SHREDDER

CROSS-REFERENCE TO RELATED APPLICATIONS

This is a continuation-in-part of prior U.S. application Ser. No. 13/362,192, filed on Jan. 31, 2012, which issued as U.S. Pat. No. 8,522,395 on Sep. 3, 2013, to which the benefit is claimed under 35 U.S.C. §120. This application also claims priority from Korean Patent Application Nos. 10-2011-0066154 and 10-2012-0072989, filed on Jul. 4, 2011 and Jul. 4, 2012, respectively, in the Korean Intellectual Property Office, the disclosures of which are incorporated herein by reference in their entirety.

BACKGROUND

1. Field

Apparatuses and methods consistent with exemplary embodiments relate to a vacuum cleaner, and more particularly, to a vacuum cleaner which collects dust on a surface to be cleaned using a suction force generated by a suction source.

2. Description of the Related Art

Recently, identity theft due to disclosure of personal information has increased and thus the need to secure the personal information becomes heightened.

In particular, although personal identification information such as a name, a phone number, and address are often described in credit card bills which are mailed after using credit cards, other receipts mails are often discarded in the trash without confirming the contents thereof for sensitive personal identification information. Accordingly, when the papers are discarded as it is without paper-shredding, the probability that the personal identification information fall into somebody's hands through various routes is high.

However, many people feel that a high-priced paper-shredder installed in their house to prevent personal information from being disclosed through waste papers is too much of a burden, and thus there is a need for an apparatus for shredding papers at a low cost and effectively collecting the shredded pieces of paper.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provides a vacuum cleaner for cleaning with a simple paper-shredding function which is capable of easily shredding papers (bills, receipts, mails, and the like) and collecting shredded pieces of paper in a dust bucket which collects dust inhaled by the vacuum cleaner, thereby essentially preventing personal information from being disclosed at a low cost without a high-priced paper-shredder.

According to an aspect of an exemplary embodiment, there is provided a vacuum cleaner. The vacuum cleaner may include: a cleaner body including a suction source configured to generate a suction force; a suction inlet body configured to inhale dust on a surface to be cleaned using the suction force of the suction source; a dust bucket detachably installed on the cleaner body and configured to separate the dust from air flowed in from the suction inlet body and collect the dust; and a paper-shredder configured to detachably communicate with an opening of the dust bucket to shred a paper and collect the shredded piece of paper in the dust bucket.

The paper-shredder may include: a first paper insertion inlet configured to allow the paper to be inserted into the paper-shredder; a pair of rotation cutters disposed in parallel to be engaged with each other and configured to shred the paper; and an opening and closing unit slidably installed inside the paper-shredder and configured to close the first paper insertion inlet when vacuum-cleaning and open the first paper insertion inlet when using the paper-shredder.

The opening and closing unit may drive the pair of rotating cutters while opening the first paper insertion inlet.

The paper-shredder may further include a limit switch configured to be turned on or off selectively according to sliding movement of the opening and closing unit.

A sealing member may be disposed between a top of the opening and closing unit and an upper inner surface of the paper-shredder and surround the first paper insertion inlet.

The dust bucket may include an upper cover configured to open and close a top of the dust bucket. The upper cover may form a shredded-paper insertion inlet configured to cause shredded pieces of paper discharged from the paper-shredder to be put in. The paper-shredder may form a shredded-paper discharge outlet corresponding to the shredded-paper insertion inlet in a lower portion thereof.

Sealing members may be disposed between the dust bucket and the paper-shredder and configured to prevent external air from being flowed in the dust bucket. The sealing members may surround peripheries of the shredded-paper insertion inlet and shredded-paper discharge outlet.

The cleaner body may include a first limit switch configured to turn on or off the suction source selectively and the dust bucket may include a push protrusion configured to turn on the first limit switch when the dust bucket is mounted on the cleaner body and turn off the first limit switch when the dust bucket is detached from the cleaner body.

The paper-shredder may further include a second limit switch configured to be turned on or off selectively according to sliding movement of the opening and closing unit and the pair of rotating cutters may operate when both of the first and second limit switches are turned on.

The dust bucket may communicate with a discharging unit of the paper-shredder to cause the shredded pieces of paper attached to a side of the discharging unit of the paper-shredder to be shaken and separated from the side of the discharging unit of the paper-shredder by cyclonic airflow formed inside the dust bucket and to be collected inside the dust bucket.

The suction source may be operated simultaneously when the paper-shredder is operated.

The dust bucket may include a cyclonic airflow forming space, and a dust collecting space surrounding the cyclonic airflow forming space.

The dust bucket may include an upper cover configured to open and close a top thereof. The upper cover may form the shredded-paper insertion inlet configured to cause the shredded pieces of paper discharged from the paper-shredder to be put in. The dust collecting space may communicate with an inside of the paper-shredder through the shredded-paper insertion inlet.

The cyclonic airflow forming space may include an exhaust tube configured to exhaust air separated from the dust outside the dust bucket; and an air turning guide formed substantially in a spiral shape along an outer circumference of the exhaust tube.

According to another aspect of an exemplary embodiment, there is provided a vacuum cleaner. The vacuum cleaner may include: a cleaner body including a suction source configured to generate a suction force; a suction inlet body configured to inhale dust on a surface to be cleaned using the suction force of the suction source; a dust bucket detachably installed on the cleaner body; a cyclonic unit formed inside the dust bucket and configured to centrifuge the dust from air flowed in through the suction inlet body; and a paper-shredder installed at a top of the dust bucket and configured to communicate with the top of the dust bucket so that shredded pieces of paper are dropped inside a dust collecting space of the dust bucket.

Additional aspects and advantages of the exemplary embodiments will be set forth in the detailed description, will be obvious from the detailed description, or may be learned by practicing the exemplary embodiments.

BRIEF DESCRIPTION OF THE DRAWINGS

The above and/or other aspects will be more apparent by describing in detail exemplary embodiments, with reference to the accompanying drawings, in which.

DETAILED DESCRIPTION

Figure 1:
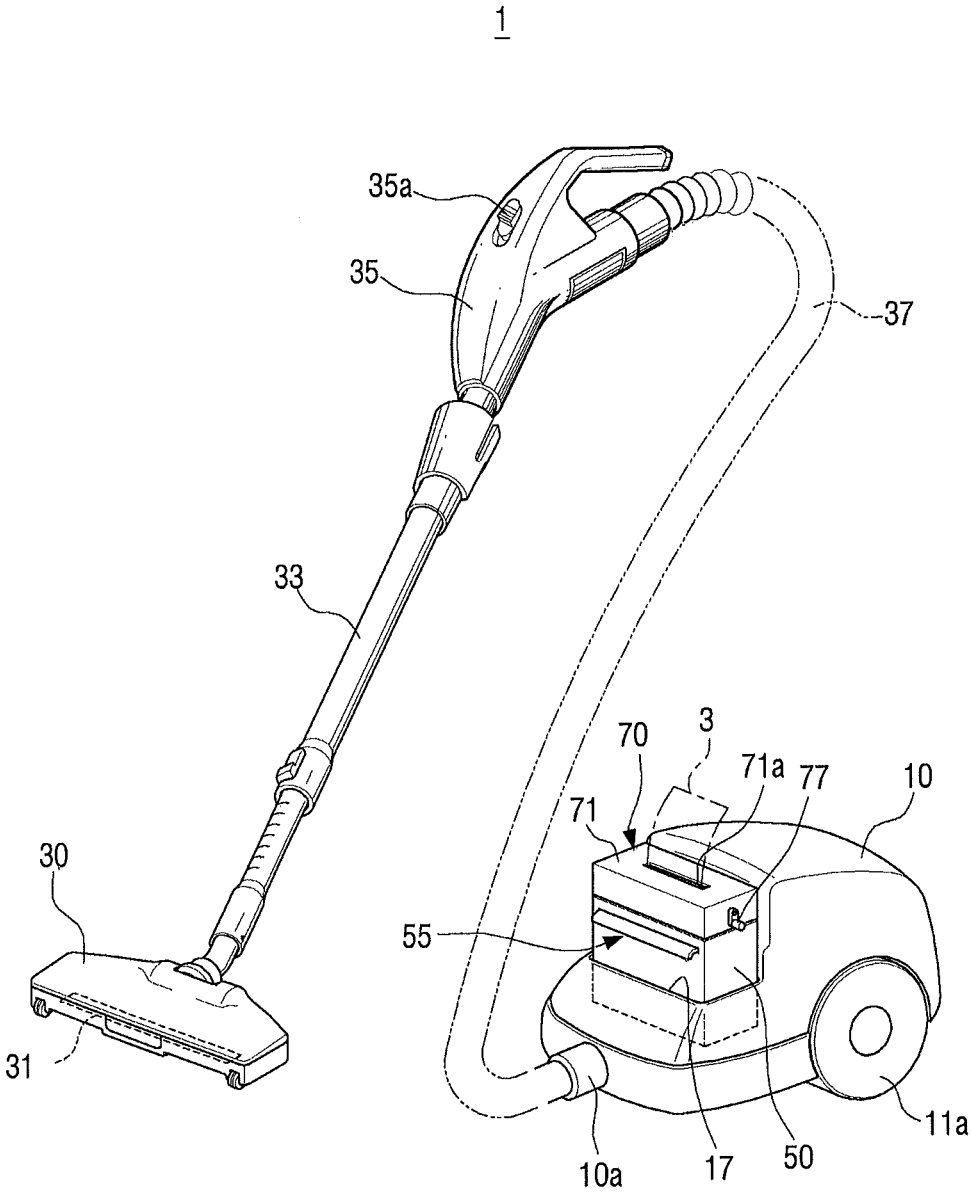
FIG. 1 is a perspective view illustrating a vacuum cleaner including a paper-shredder according to a first exemplary embodiment.

Hereinafter, exemplary embodiments will be described in more detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Configurations of vacuum cleaners including paper-shredders according to first to fourth exemplary embodiments will be sequentially described with reference to the accompanying drawings below.

Referring to FIG. 1, a vacuum cleaner 1 according to a first exemplary embodiment is a canister type vacuum cleaner and includes a cleaner body 10, a suction inlet body 30, a dust bucket 50, and a paper-shredder 70.

To cause the cleaner body 10 to smoothly move on a surface to be cleaned, main wheels 11*a* are installed at both sides of the cleaner body 10 and an auxiliary wheel (not shown) is installed at a front of the bottom thereof.

Figure 2:
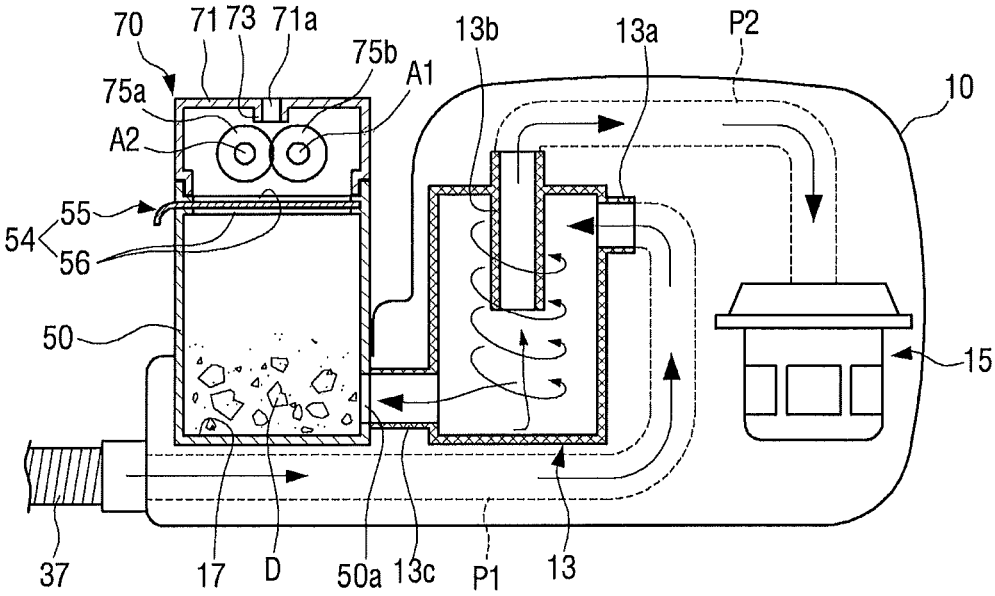
FIG. 2 is a schematic cross-sectional view illustrating an inner structure of the vacuum cleaner including a paper-shredder according to the first exemplary embodiment.

Referring to FIG. 2, a cyclonic unit 13 configured to centrifuge dust D inhaled with air from the surface to be cleaned from the air and a suction motor 15 corresponding to a suction source are embedded in the cleaner body 10.

In this case, the cleaner body 10 includes a first flow path configured to connect a suction port 10*a* installed at a front end of the cleaner body 10 and an inlet 13*a* of the cyclonic unit 13 to guide air containing dust flowing in the inside of the cleaner body 10. The cleaner body 10 includes second flow path configured to connect an air exhaust outlet 13*b* of the cyclonic unit 13 and an inlet 15*a* of the suction motor 15 to guide the air separated from the dust D in the cyclonic unit 13 to the suction motor 15.

Referring to FIG. 1, the suction inlet body 30 forms a suction inlet 31 in a bottom thereof in contact with the surface to be cleaned and is communicably coupled to one end of an extension tube 33 which has a telescopic structure and is expandable and contractible. The extension tube 33 and an extension hose 37 communicate with each other through a handle 35. In this case, a slide button 35*a* configured to turn on/off the suction motor 15 and control intensity of a suction force is installed on one surface of the handle 35. The other end of the extension hose 37, which one end communicates with the handle 35, communicates with the suction port 10*a* of the cleaner body 10.

Therefore, the air containing the dust D flowed in into the suction inlet 31 of the suction inlet body 30 sequentially passes through the extension tube 33, an inside of the handle 35, and the extension hose 37, which forms a moving path, and flows in the first flow path inside the cleaner body 10.

Referring to FIG. 2, the dust bucket 50 is detachably coupled to a containing groove 17 formed in the cleaner body 10. In this case, a dust exhaust port 13*c* configured to exhaust the dust D from the cyclonic unit 13 is installed at one side surface of the containing groove 17. One end of the dust exhaust port 13*c* communicates with a lower portion of the cyclonic unit 13. When the dust bucket 50 is mounted on the containing groove 17 of the cleaner body 10, the other end of the dust exhaust port 13*c* communicates with a dust inlet 50*a* formed in one surface of the dust bucket 50.

Figure 3:
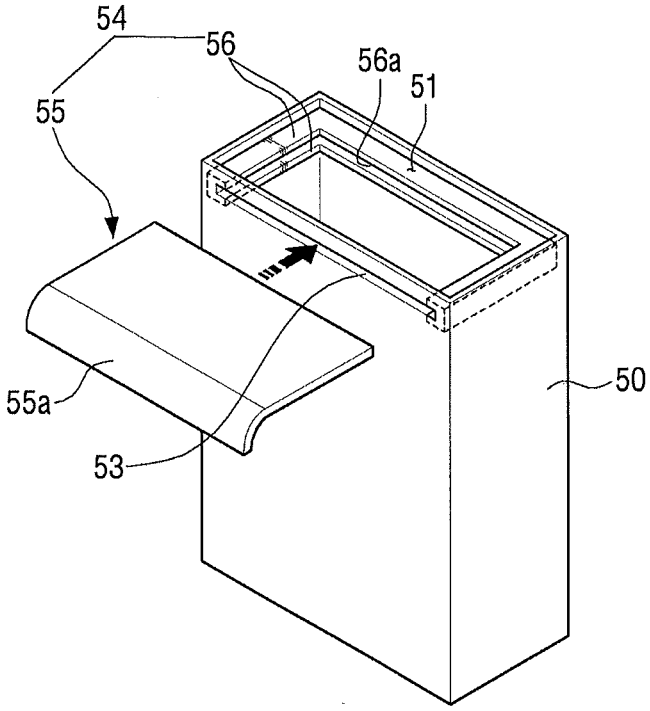
FIG. 3 is a perspective view illustrating an airtight structure of a dust bucket using a shielding plate illustrated in FIG. 2.

Referring to FIG. 3, the dust bucket 50 has a bucket shape with an opening 51 at a top thereof and an insertion hole 53, into which a shielding plate 55 is slidably inserted, is formed in one surface of the dust bucket.

The dust bucket 50 remains communicated with a bottom of the paper-shredder 70 to cause the dust bucket 50 to collect shredded pieces of paper (3 of FIG. 1) supplied from the paper-shredder 70 mounted on the opening 51. In this case, since a paper insertion inlet 71*a* of the paper-shredder 70, which has substantially elongated slit and is configured to allow the paper 3 to be inserted, is always opened, the inside of the dust bucket 50 remains under atmospheric pressure. When the inside of the dust bucket 50 remains under atmospheric pressure, a flow pass from the suction inlet body 30 to the suction motor 15 may not properly remain under vacuum at the time of vacuum-cleaning. So as to prevent this, the dust bucket 50 includes an opening and closing unit 54 configured to close the opening 51 at the time of vacuum-cleaning and open the opening 51 at the time of using the paper-shredder 70.

The opening and closing unit 54 includes the shielding plate 55 configured to be led in and to be withdrawn out along the insertion hole 53 of the dust bucket 50 and a pair of guide ribs 56 configured to be air-tightly coupled to the shielding plate 55.

The shielding plate 55 forms an outer shape corresponding to a shape of the dust bucket 50 and is formed so that one end 55*a* of the shielding plate 55 protruding outward from the dust bucket 50 is bent to allow a user to lead in and withdraw out easily the shielding plate 55 from the dust bucket 50.

The pair of guide ribs 56 are continuously formed parallel to each other at intervals along an inner circumferential surface of the dust bucket 50 to form a joint groove 56*a*. The pair of guide ribs 56 are formed to have the same thickness as the shielding plate 55 or a thickness slightly smaller than that of the shielding plate 55 so that an edge of the shielding plate 55 to be pressed and inserted into the joint groove 56*a*.

At this time, a sealing member (not shown) is provided along the joint groove 56*a* to enhance airtight between the shielding plate 55 and each of the pair of the guide ribs 56 and a sealing member (not shown) is provided in an inner side of the insertion hole 53 of the dust bucket 50, through which the shielding plate 55 passes.

Figure 4:
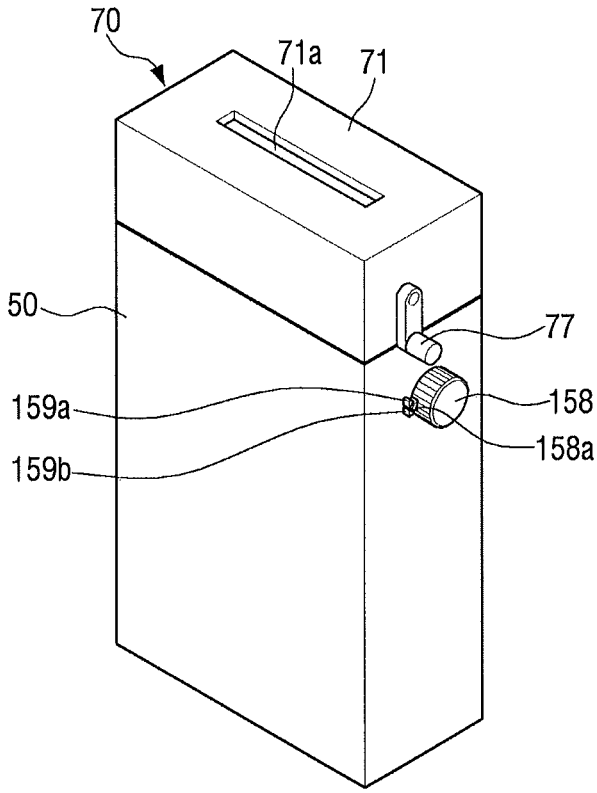
FIG. 4 is a perspective view illustrating an airtight structure of a dust bucket using a valve according to another exemplary embodiment.
Figure 5:
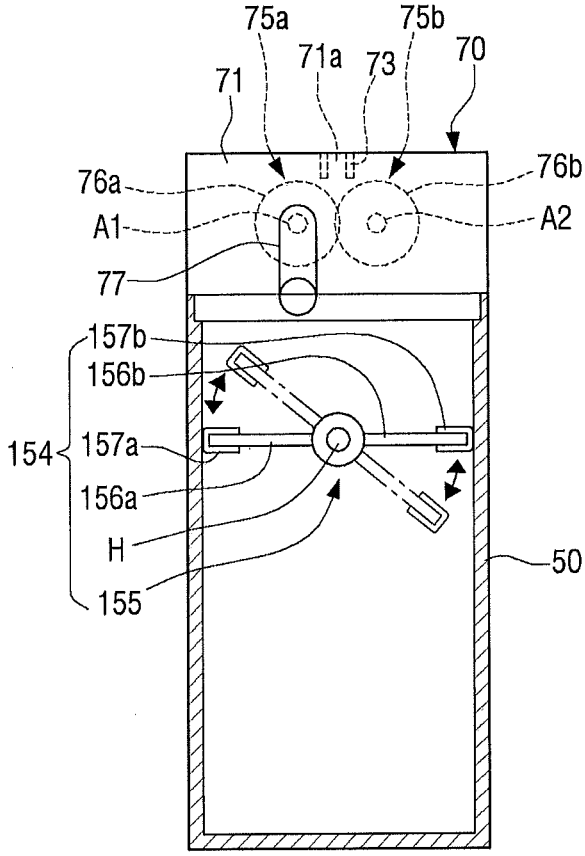
FIG. 5 is a schematic cross-sectional view illustrating an inside of the dust bucket illustrated in FIG. 4.
Figure 6:
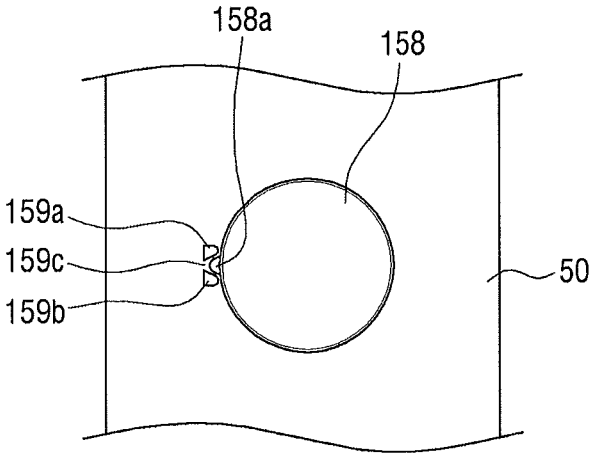
FIG. 6 is a side view illustrating a locking structure of a rotation knob illustrated in FIG. 4.

The dust bucket 50 may include a valve type opening and closing unit 154 as shown in FIGS. 4 to 6 instead of the above-described opening and closing unit 54.

Referring to FIG. 5, the opening and closing unit 154 include a valve 155 pivotally installed inside the dust bucket 50 to be rotated through a hinge shaft H. The valve 155 includes a pair of swing sections 156*a* and 156*b* symmetrically provided at both sides based on a rotation center to open and close the opening 51 of the dust bucket 50. Ends of the pair of swing sections 156*a* and 156*b* contact with an inner circumferential surface of the dust bucket 50 and are coupled to sealing members 157*a* and 157*b*. Therefore, an airtight sealing can be enhanced when the opening 51 of the dust bucket 50 is closed.

Referring to FIG. 6, the opening and closing unit 154 includes a rotation knob 158 exposed outward from the dust bucket 50 to allow the user to rotate the valve 155. The rotation knob 158 is connected to the hinge shaft H and rotates the valve 155 in a bidirectional direction, thereby opening and closing the opening 51 of the dust bucket 50.

In this case, to keep the valve 15 closed, a locking protrusion 158*a* configured to lock the rotation knob 158 is formed on an outer circumference of the rotation knob 158 and a pair of fixing protrusions 159*a* and 159*b*, to which the locking protrusion 158*a* is snap-coupled, are formed on an outer surface of the dust bucket 50.

The pair of fixing protrusions 159*a* and 159*b* are set to positions corresponding to an angle at which the pair of swing sections 156*a* and 156*b* closes the opening 51 of the dust bucket 50. The pair of fixing protrusions 159*a* and 159*b* are formed at intervals to form a joint groove 159*c* to which the locking protrusion 158*a* is coupled.

The paper-shredder 70 shreds papers such as receipts and is installed at the opening 51 formed in an upper side of the dust bucket 50 to communicate with the opening 51. In this case, the paper-shredder 70 is installed on the dust bucket 50 and thus shredded pieces of paper are naturally collected into the dust bucket 50 by their own weight.

The paper-shredder 70 may be configured with a manual type or an automatic type. First, an example in which the paper-shredder is configured with the manual type will be described.

Referring to FIGS. 2 and 5, the paper-shredder 70 includes a housing 71, a pair of rotation cutters 75*a* and 75*b*, and a rotation handle 77.

The housing 71 includes the paper insertion inlet 71*a* formed on a top of the housing 71, configured to allow the paper to be inserted into an inside thereof, and has an opened bottom to allow the shredded pieces of paper to be dropped to the dust bucket 50. A sealing member (not shown) having a loop shape may be coupled to a coupling portion between the housing 71 and dust bucket 50 (a lower end of the housing 71 and an upper end of the opening 51 of the dust bucket 50) to keep airtight between the housing 71 and the dust bucket 50.

The housing 71 includes a guide protrusion 73 which is formed and extends along a bottom end of the paper insertion inlet 71*a*. The guide protrusion 73 guides a front end of the paper 3 inserted through the paper insertion inlet 71*a* to move toward a portion in which the pair of rotation cutter 75*a* and 75*b* are engaged with each other.

The pair of rotation cutters 75*a* and 75*b* are rotatably installed inside the housing 71 and include blade sections 76*a* and 76*b* radially formed in an outer circumference at intervals to shred the paper 3 inserted into the housing 71 through the paper insertion inlet 71*a*. In this case, the pair of rotation cutters 75*a* and 75*b* are disposed to be engaged parallel to each other (specifically, so that the blade sections 76*a* and 76*b* of the rotation cutters 75*a* and 75*b* are alternatively disposed to each other). Therefore, the paper passes between the pair of rotation cutters 75*a* and 75*b* and are shredded into a plurality of pieces of paper having a narrow width.

Gears (not shown), which are mutually engaged with ends of rotation shafts A1 and A2 of the rotation cutters 75*a* and 75*b*, are installed so that one of the pair of rotation cutters 75*a* and 75*b* is rotated in one direction, and the other thereof is rotated in a reverse direction.

One end of the rotation handle 77 is connected to the rotation shaft A1 of any one 75*a* of the pair of the rotation cutters 75*a* and 75*b*. In this case, the rotation handle 77 is exposed outside the housing 71 to be manipulated by the user.

The manual paper-shredder 70 having the above-described configuration will be described below. First, the user opens the opening 51 of the dust bucket 50 through the opening and closing unit 54 or 154 before using the paper-shredder 70. Then, the user inserts the paper into the paper insertion inlet 71*a* using his/her one hand and rotates the rotation handle 77 using his/her other hand, so that the paper-shredder 70 shreds the paper.

Figure 7:
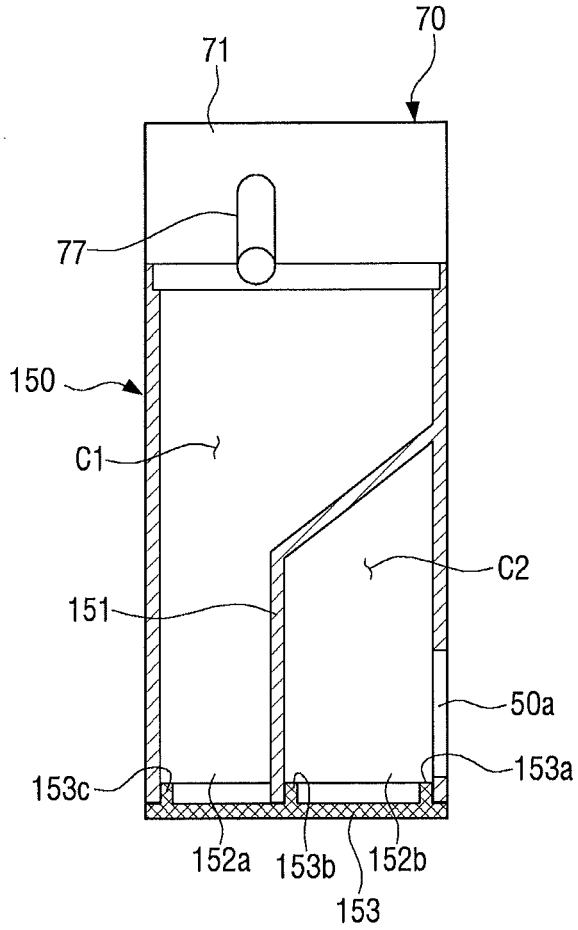
FIG. 7 is a perspective view illustrating a configuration of a dust bucket partitioned into a first chamber and a second chamber according to still another exemplary embodiment.

Referring to FIG. 7, a dust bucket 150 may include a partition plate 151 formed therein to partition a chamber C1 configured to collect pieces of paper discharged from the paper-shredder 70 and a second chamber C2 configured to collect the dust exhausted from the cyclonic unit 13. In this case, the pieces of paper and dust collected in the first and second chambers C1 and C2 are exhausted through first and second exhaust outlets 152*a* and 152*b* in the bottom of the dust bucket 150, respectively.

The first and second exhaust outlets 152*a* and 152*b* are simultaneously opened or closed by an exhaust cover 153. The exhaust cover 153 includes first to third joint protrusions 153*a*, 153*b*, and 153*c* formed to be detachably coupled to the first and second exhaust outlets 152*a* and 152*b*. The first and second joint protrusions 153*a* and 153*b* are coupled to sealing members (not shown) in the outside thereof to maintain air-tight sealing of the second chamber C2.

As described above, when the dust bucket 150, of which the inside is partitioned by the partition plate 151, is applied, the second chamber remains air-tight by the exhaust cover 153 and thus the opening and closing units 54 and 154 may be omitted.

Figure 8:
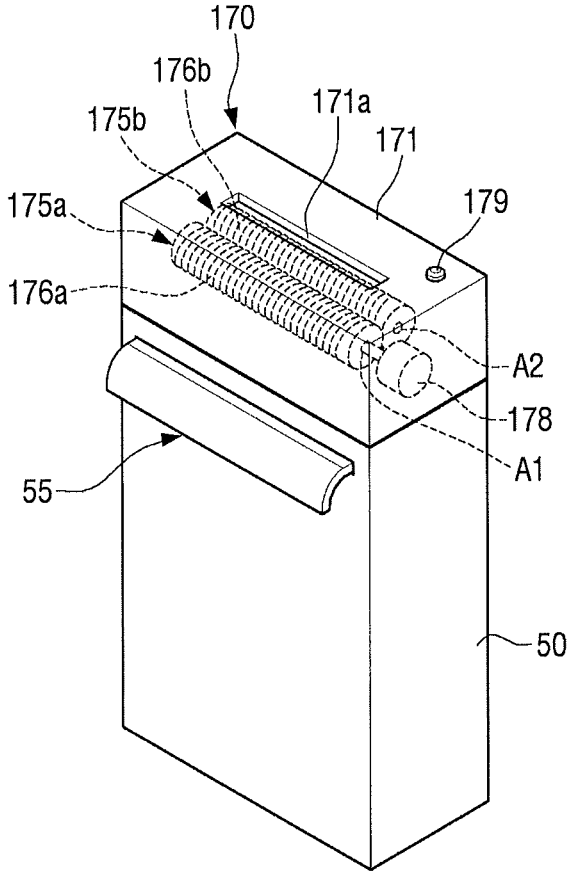
FIG. 8 is a perspective view illustrating a power shredding type paper-shredder according to another exemplary embodiment.

Referring to FIG. 8, an automatic paper-shredder 170 may be applied to the present inventive concept other than the above-described paper-shredder 70.

The automatic paper-shredder 170 includes a housing 171, a paper insertion inlet 171*a*, a guide protrusion (not shown), and a pair of rotation cutters 175*a* and 175*b* like the manual paper-shredder 70.

Further, the paper-shredder 170 includes a motor 178 which is connected to a rotation shaft A1 of any one 175*a* of the pair of rotation cutters 175*a* and 175*b* and drives the rotation cutter 175*a*, and a manipulation button 179 configured to turn on/off the motor 178. The manipulation button 179 is electrically connected to a circuit unit (not shown) configured to apply power the motor 178 and disposed on a predetermined position of the outside of the housing 171.

A method of using the above-described automatic paper-shredder 170 will be described below. First, the user opens the opening 51 of the dust bucket 50 through the opening and closing unit 54 or 154 and presses the manipulation button 179 to turn on the driving motor 178. When the user inserts a paper into the paper insertion inlet 171*a*, the paper is shredded through the rotation cutters 175*a* and 175*b* rotated by the driving motor 178 and then collected in the dust bucket 50.

Alternatively, the paper-shredder 170 may be operated in a semi-automatic type in which the rotation cutters 175*a* and 175*b* are operated only while the user presses the manipulation button 179 according to design of the circuit unit. The non-described reference numerals 176*a* and 176*b* in FIG. 8 refer to the blade sections of the rotation cutters 175*a* and 175*b*.

A configuration of an upright type vacuum cleaner 1*a* to which a paper-shredder 270 is installed according to a second exemplary embodiment will be described with reference to FIGS. 9 and 10.

The upright type vacuum cleaner 1*a* includes a cyclonic unit and a suction motor inside a cleaner body 210 like the canister type vacuum cleaner 1 described above. However, a dust bucket 250 and a paper-shredder 270 are mounted on the cleaner body 210 so that the dust bucket 250 and the paper-shredder 270 are not entirely exposed outside the cleaner body 210 but partially exposed from the cleaner body 210.

Accordingly, the dust bucket 250 may include an opening and closing unit 254 configured to open and close an opening of the dust bucket 250 using a shielding plate 255 and guide ribs 256 by considering that the dust bucket 250 is partially exposed.

The paper-shredder 270 may have the same configuration as the automatic paper-shredder 170 rather than the manual paper-shredder 70. However, by considering that only a front of the housing 271 in the paper-shredder 270 is exposed, as shown in FIG. 9, a paper insertion inlet 271*a* and a manipulation button 279 are disposed in the front of the housing 271 and a guide protrusion 273 is disposed to be guided in a portion in which the pair of rotation cutters 275*a* and 275*b* are engaged with each other from the paper insertion inlet 271*a*.

Figure 9:
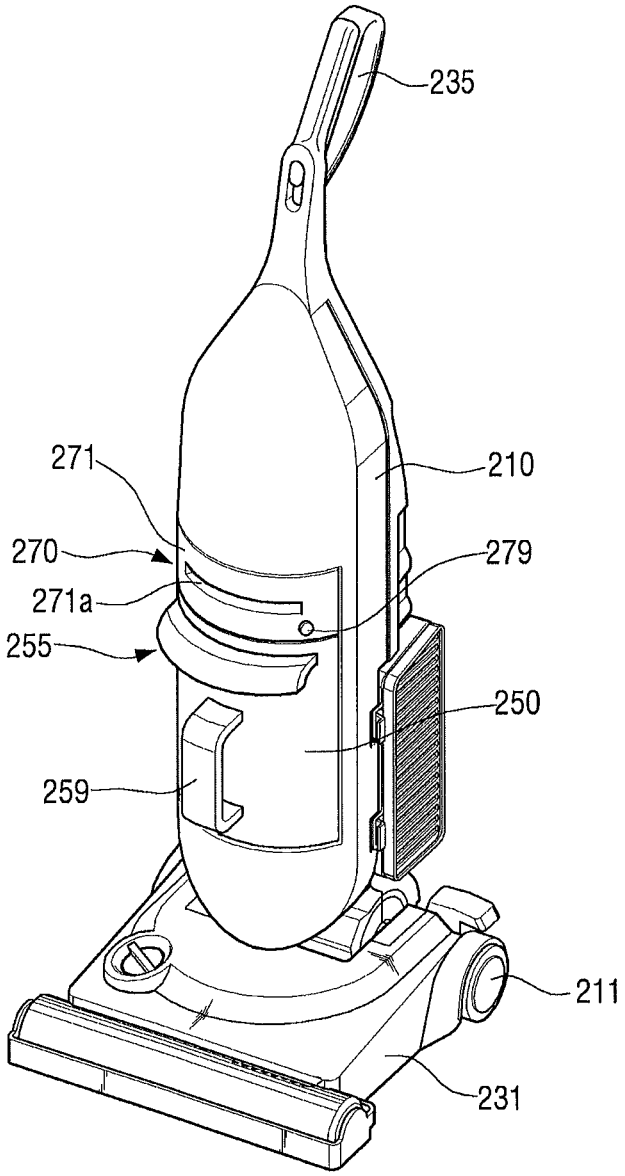
FIG. 9 is a perspective view illustrating a vacuum cleaner including a paper-shredder according to a second exemplary embodiment.
Figure 10:
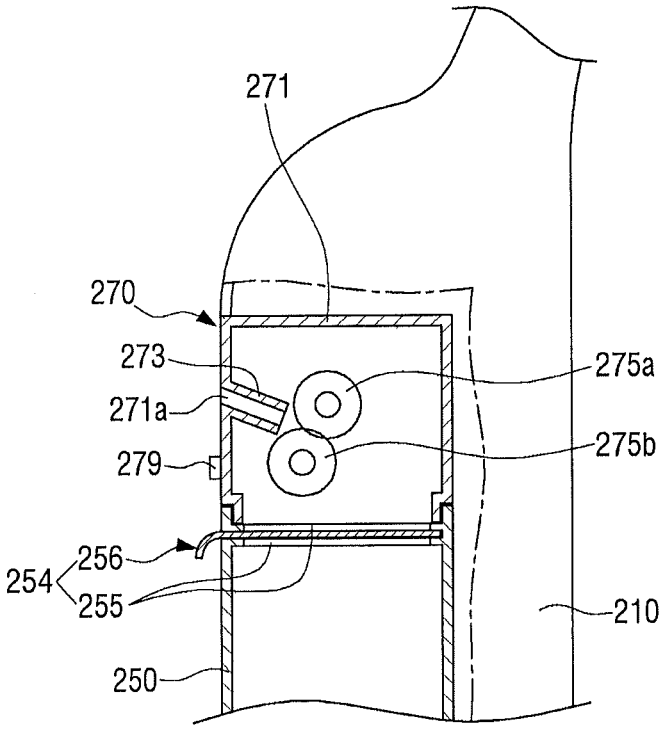
FIG. 10 is a schematic cross-sectional view illustrating a paper-shredder and a dust bucket illustrated in FIG. 9.

In FIG. 9, the reference numeral 211 denotes a wheel installed at both sides of the cleaner body 210, 231 denotes a suction inlet body hinge-connected to a bottom of the cleaner body 210 so that the suction inlet body communicates with the cleaner body 210, 235 denotes a handle configured to move the cleaner body 210, and 259 denotes a withdraw knob configured to withdraw the dust bucket 250 from the cleaner body 210.

A configuration of a robot vacuum cleaner 1*b* to which a paper-shredder 370 is installed according to a third exemplary embodiment will be described with reference to FIG. 11.

In the robot vacuum cleaner 1*b* according to the third exemplary embodiment, a suction inlet 311 facing a surface to be cleaned is formed at a bottom of the cleaner body 310, and a suction source configured to inhale dust such as an impeller 379 and a driving motor 378 are disposed on suction paths (P, that is, P3, P4, and P5) from the suction inlet 311 to the dust bucket 350.

The impeller 379 receives a rotation force from the driving motor 378 to be rotated and is disposed between the suction inlet 311 and the dust bucket 350. When the impeller 379 is used, vacuum is formed in a portion of the suction path P, which is from the suction inlet 311 and a chamber 313 in which the impeller 379 is installed.

Therefore, in the robot vacuum cleaner according to the third exemplary embodiment, the dust bucket 350 is installed at the rear of the impeller 379, the inside of the dust bucket 350 needs not remain at atmospheric pressure and thus the opening and closing units 54, 154, and 254 included in the dust bucket 50, 150 and 250 described in the first and second exemplary embodiments may be omitted.

As the paper-shredder 370 applied to the third exemplary embodiment, the above-described paper-shredder 70 (see FIG. 5) may be applied. The above-described automatic paper-shredder 170 (see FIG. 7) may be included in the robot vacuum cleaner 1*b* so that the portion of the paper-shredder 370 is embedded in the cleaner body 310 and an overall volume of the robot vacuum cleaner 1*b* is kept compact.

Figure 11:
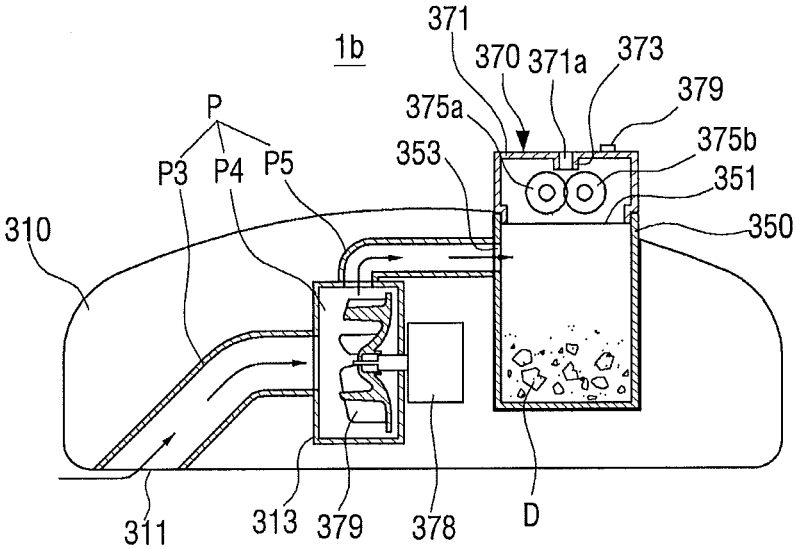
FIG. 11 is a schematic cross-sectional view including a paper-shredder according to a third exemplary embodiment.

In FIG. 11, the reference numeral 351 denotes an opening of the dust bucket 350, 353 denotes a dust inlet configured to drop dust in the dust bucket 350 through the suction path P5, 371 denotes a housing, 371*a* denotes a paper insertion inlet, 373 denotes a guide protrusion, 375*a* and 375*b* denote rotation cutters, 379 denotes a manipulation button, and D denotes the dust, respectively.

Figure 16:
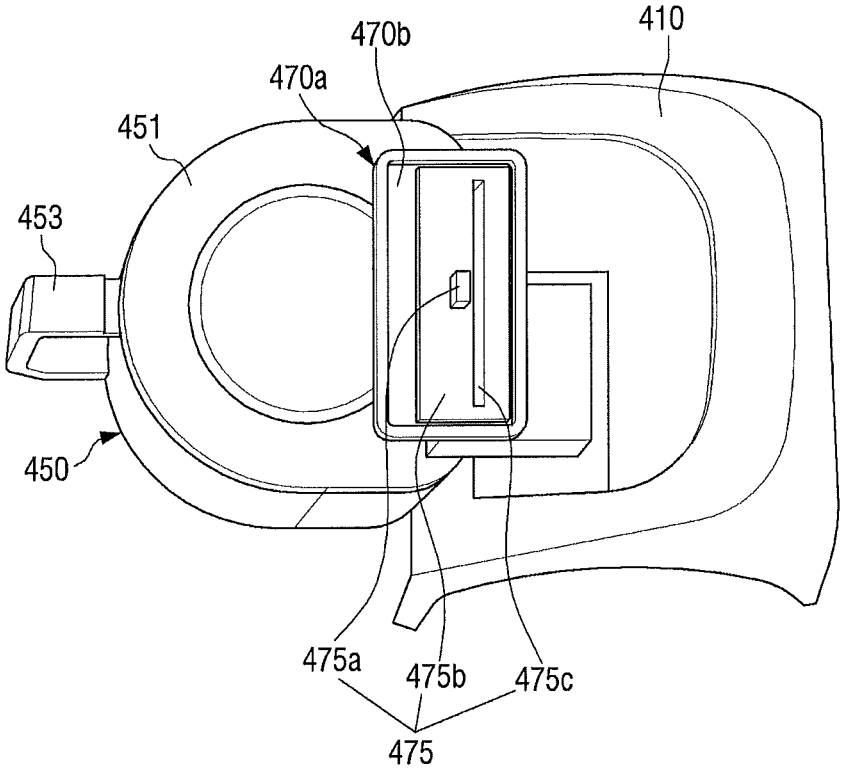
FIG. 16 is a perspective view illustrating a part on which an operation lever of a paper-shredder is installed illustrated in FIG. 13.

A vacuum cleaner including a paper-shredder according to a fourth exemplary embodiment will be described below with reference to FIGS. 12 to 14. Only a portion of the cleaner body 410 in FIGS. 12, 14, and 16, in which the dust bucket 450 is installed, is illustrated. The cleaner body 410 communicates with a suction inlet body (not shown) configured to inhale dust of a surface to be cleaned using a suction force of a suction motor which will be described later.

Figure 12:
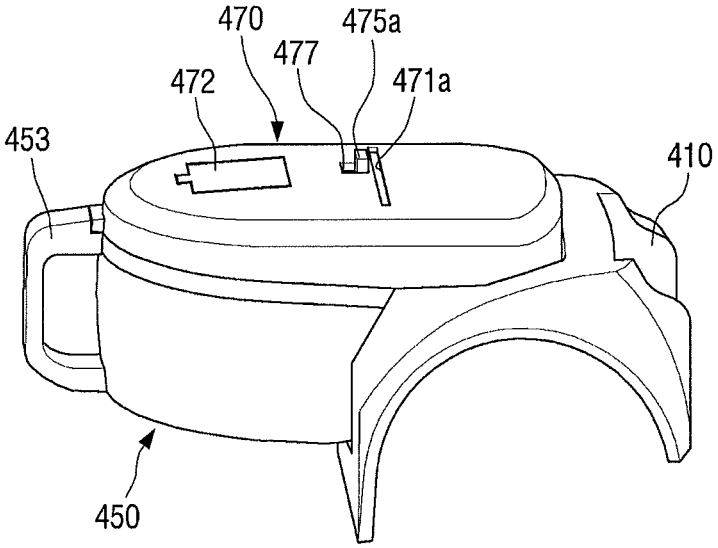
FIG. 12 is a schematic perspective view illustrating a part of a vacuum cleaner including a paper-shredder according to a fourth exemplary embodiment.

Referring to FIG. 12, the suction motor (not shown) configured to inhale the dust of the surface to be cleaned or air and collect the dust or air in the dust bucket 450 is included in the cleaner body 410 of the vacuum cleaner.

The dust bucket 450 is detachably mounted on the cleaner body 410, and has an opened top. The dust bucket 450 includes a cyclonic airflow forming space 453 configured to form cyclonic airflow for separating dust from air, and a dust collecting space 454 surrounding the cyclonic airflow forming space 453, which are formed therein.

The upper cover 451 is coupled to the dust bucket 450 to open and close the opened top of the dust bucket 450. The paper-shredder 470 is safely and detachably mounted on the upper cover 451 and a shredded-paper insertion inlet 452, which is configured to allow shredded pieces of paper discharged from the paper-shredder 470 to be put in, is formed in the upper cover 451.

Figure 13:
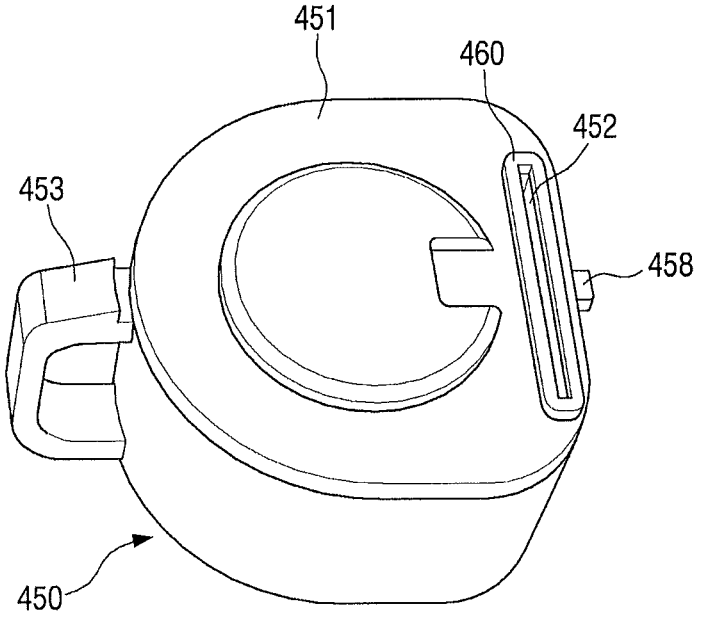
FIG. 13 is a perspective view illustrating an exterior appearance of a dust bucket illustrated in FIG. 12.

Referring to FIG. 13, the shredded-paper insertion inlet 452 has substantially an elongated slit to correspond to an arrangement of the pair of rotation cutters 476*a* and 476*b* in a length direction. A sealing member 460 is coupled along a periphery of the shredded-paper insertion inlet 452.

The sealing member 460 is configured to maintain airtight between the upper cover 451 and a bottom of the paper-shredder 470. The sealing member 460 may block external air at a time of vacuum-cleaning and smoothly maintain the cyclonic airflow formed inside the dust bucket 450. This exemplary embodiment has illustrated an example in which the sealing member 460 is installed at the upper cover 451 of the dust bucket 450, but it is not limited thereto. The sealing member 460 may be installed at the bottom of the paper-shredder 470. At this time, the sealing member 460 may be disposed to surround at a periphery of the shredded-paper insertion inlet 452.

In addition, a push protrusion 458 is formed at one end of the upper cover 451 facing the clean body 410. The push button 458 operates a first limit switch LS1 when the dust bucket 450 is detached from the cleaner body 410.

The first limit switch LS1 is installed at a portion of the cleaner body 410. The first limit switch LS1 is turned on by the push protrusion 458 when the dust bucket 450 is mounted on the cleaner body 410, while the first limit switch LS1 is turn off by releasing pressure by the push protrusion 458 when the dust bucket 450 is detached from the cleaner body 410.

In this case, the first limit switch LS1 may cause a control unit (not shown) of the vacuum cleaner according to this exemplary embodiment to drive a suction motor (not shown) installed in the cleaner body 410 and a driving motor (not shown) (a driving unit configured to rotatably drive the rotation cutters) included in the paper-shredder 470. That is, the suction motor of the cleaner body 410 and the driving motor of the paper-shredder 470 may be operated when the first limit switch LS1 is turned on, while the suction motor and the driving motor is not operated when the first limit switch LS1 is turned off. Therefore, the first limit switch LS1 serves as a safe device configured to stop a paper-shredding operation and a vacuum-cleaning operation when the dust bucket 450 is detached from the cleaner body 410.

Figure 14:
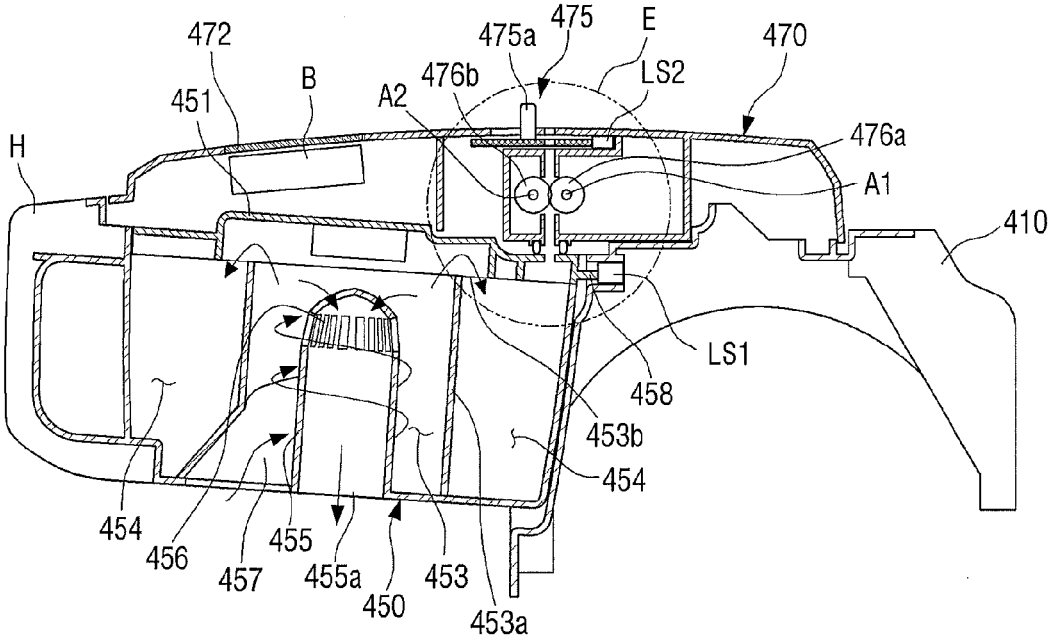
FIG. 14 is a perspective view illustrating an inside of a dust bucket and an inside of a paper-shredder illustrated in FIG. 12.

Referring to FIG. 14, a knob H is formed in an outside of the dust bucket 450. The knob H may be often used when the dust bucket 450 is mounted on or detached from the cleaner body 410 and when the dust bucket 450 is carried.

Further, the dust bucket 450 includes the cyclonic airflow forming space 453 and the dust collecting space 454 described above in an inside of the dust bucket 450.

The cyclonic airflow forming space 453 includes an exhaust tube 455 and an air turning guide 456.

The exhaust tube 455 is a path configured to exhaust the air separated from dust by the cyclonic airflow formed in the dust collecting space 454 outside the dust bucket 450 through an exhaust outlet 455*a* formed a bottom end of the exhaust tube 455. A grill type filter 456 is mounted on an upper-end opening of the exhaust tube 455, through which dust is flowed in, and filters the dust flowing in the exhaust tube 455 and contained in the air flowing in the exhaust tube 455.

The air turning guide 456 guides the air containing dust to the dust collecting space 454 of the dust bucket 450. At this time, the air turning guide 456 has substantially a spiral shape along an outer circumference of the exhaust tube 455 to add a turning force to the air. Therefore, the air moves along the air turning guide 456 to obtain the turning force and flows in the dust collecting space 454 to form the cyclonic airflow. Thus, the dust contained in the air is effectively separated from the air by a centrifugal force.

The dust collecting space 454 is partitioned from the cyclonic air forming space 453 by a cylindrical partition 453*a*. In this case, a dust exhaust path 453*b*, which is configured to allow the dust centrifuged from the air to be exhausted from the cyclonic air forming space 453, is formed between a top of the partition 453*a* and the bottom of the upper cover 451.

The dust collecting space 454 communicates with the inside of the paper-shredder 470 through the shredded-paper insertion inlet 452 of the upper cover 451. Therefore, the shredded pieces of paper discharged from the paper-shredder 470 are collected in the dust collecting space 454 through the shredded-paper insertion inlet 452.

The paper-shredder 470 may be configured to have a manual type or an automatic type and an example of the automatic paper-shredder 470 will be described in a fourth exemplary embodiment.

Referring to FIG. 14, when the paper-shredder 470 is detachably coupled to the upper cover 451 of the dust bucket 450. A portion of the paper-shredder 470 protrudes from the upper cover 451. When the paper-shredder 470 is mounted on the cleaner body 410 together with the dust bucket 450, the paper-shredder 470 covers a portion of the cleaner body 410.

The first paper insertion inlet 471*a* configured to allow a paper to be shredded to be inserted is formed on the paper-shredder 470 to have an elongated slit and the paper-shredder 470 includes the opening and closing unit 475 configured to open and close the first paper insertion inlet 471*a*.

The opening and closing unit 475 includes a lever 475*a* protruding outward from the paper-shredder 470, and an opening and closing plate 475*b* reciprocally installed inside the paper-shredder 470 in a straight direction.

The lever 475*a* is formed on an upper surface of the opening and closing plate 475*b* to extend from the upper surface of the opening and closing plate 475*b* and is exposed outward from the paper-shredder 470 to be manipulated by the user. The lever 475*a* moves the opening and closing plate 475*b* in a bidirectional direction to open and close the first paper insertion inlet 471*a*. In this case, a predetermined escaping groove 477 is formed on the paper-shredder 470 to cause the lever 475*a* to move linearly reciprocally.

The opening and closing plate 475*b* is slidably safely held to an upper surface 470*b* of a support 470*a* formed inside the paper-shredder 470. In addition, a second paper insertion inlet 475*c* is formed in the opening and closing plate 475*b* to be in parallel to the first paper insertion inlet 471*a* of the paper-shredder 470. The second paper insertion inlet 475*c* opens the first paper insertion inlet 471*a* while the second paper insertion inlet 475*c* moves to a position which matches the first paper insertion inlet 471*a* according to movement of the opening and closing plate 475*b*.

A third paper insertion inlet 470*c* is formed in a support 470*a* to which the opening and closing plate 475*b* is safely held. The third paper insertion inlet 470*c* is formed in a position which match the first paper insertion inlet 471*a* in a distance spaced from the first paper insertion inlet 471*a*.

Therefore, the first and third paper insertion inlets 471*a* and 470*c* are simultaneously opened by the opening and closing plate 475*b*.

Sealing members 461 and 463 are disposed between the top surface of the opening and closing plate 456*b* and an inner surface of an upper portion of the paper-shredder 470 and between a bottom surface of the opening and closing plate 456*b* and the top surface 470*b* of the support 470*a*. The opening and closing plate 456*b* prevents external air from flowing inside the dust bucket 450 through the paper-shredder 470 and prevents the cyclonic airflow from being affected by the external air when vacuum-cleaning in a state that the first and third paper insertion inlets 471*a* and 470*c* are closed by the opening and closing plate 456*b*.

Further, the paper-shredder 470 includes a second limit switch LS2 therein. The second limit switch LS2 is operated by movement of the opening and closing plate 475*b* of the opening and closing unit 475. That is, while the opening and closing plate 475*b* opens the first and third paper insertion 471*a* and 470*c*, one end of the opening and closing unit 475*b* presses the second limit switch LS2 and turns on the second limit switch LS2. Accordingly, when the second limit switch LS2 is turned on, the driving motor (not shown) configured to rotate the pair of rotation cutters 476*a* and 476*b* is operated. The opening and closing unit 475 opens the first and third paper insertion inlets 471*a* and 470*c* and simultaneously operates the paper-shredder 470.

The driving motor of the paper-shredder 470 are operated when the first limit switch LS1 is turned on in a state that the second limit switch LS2 is turned on (that is, the dust bucket 450 is mounted on the cleaner body 410).

Figure 15:
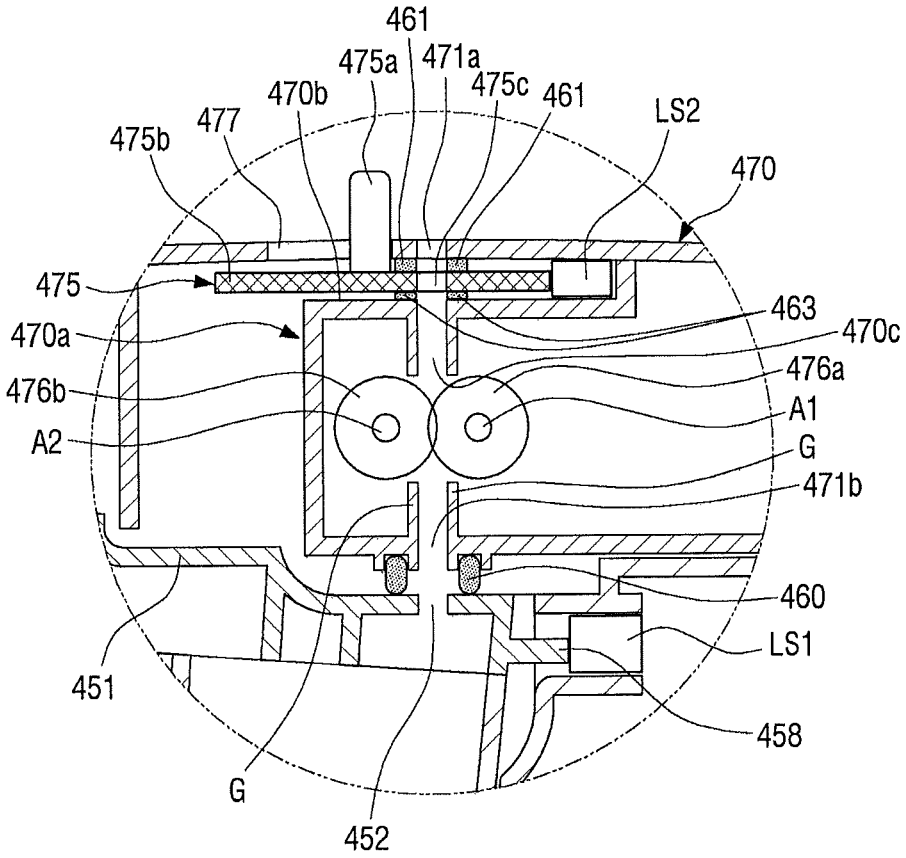
FIG. 15 is an enlarged cross-sectional view illustrate a portion "E" illustrated in FIG. 14.

The support 470*a* includes a guide G and a shredded-paper exhaust outlet 471*b* below the pair of rotation cutters 476*a* and 476*b*. The guide G prevents shredded pieces of paper discharged from the pair of rotation cutters 476*a* and 476*b* from being left inside the paper-shredder 470 and guides the shredded pieces of paper to be smoothly discharged through the shredded-paper exhaust outlet 471*b*. The shredded-paper exhaust outlet 471*b* may be set to a position corresponding to the shredded-paper insertion inlet 452 formed on the upper cover 451 of the dust bucket 450. FIG. 15 has illustrated that the guide G and the shredded-paper exhaust outlet 471*b* are formed to extend below the support 470*a*, but it is merely an example. The guide G and the shredded-paper exhaust outlet 471*b* may be formed to extend below the paper-shredder 470.

When paper is shredded by the paper-shredder having the above-described configuration of the fourth exemplary embodiment, some of the shredded pieces of paper passing through the pair of rotation cutters 476*a* and 476*b* may not be separated from the pair of rotation cutters 476*a* and 476*b* and may hang on the pair of rotation cutters 476*a* and 476*b*. In this case, the suction motor may be operated when the paper-shredder 470 is operated. It is preferable that the suction motor be controlled to provide a suction force less than that in normal cleaning and the weak cyclonic airflow be formed in the dust collecting space 454 of the dust bucket 450. Thus, the cyclonic airflow causes the shredded pieces of paper hanged on exhausted sides of the pair of rotation cutters 476*a* and 476*b* to be shaken. Therefore, the shredded pieces of paper are smoothly separated from the exhaust side of the pair of rotation cutters 476*a* and 476*b* to be dropped in the dust collecting space 454 of the dust bucket 450.

The above-described first to fourth exemplary embodiments install the paper-shredders 70, 170, 270, 370, and 470 on the canister type vacuum cleaner, the upright type vacuum cleaner, and the robot vacuum cleaner to further include a function to shred papers including personal information (bills, receipts, mails, and the like). Therefore, disclosure of the personal information is essentially prevented and convenience of user is enhanced.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A vacuum cleaner, comprising:

a cleaner body including a suction source configured to generate a suction force;

a suction inlet body configured to inhale dust on a surface to be cleaned using the suction force of the suction source;

a dust bucket detachably installed on the cleaner body and configured to separate the dust from air flowed in from the suction inlet body and collect the dust; and a paper-shredder configured to detachably communicate with an opening of the dust bucket to shred a paper and collect the shredded pieces of paper in the dust bucket, wherein the paper-shredder comprises a first paper insertion inlet configured to allow the paper to be inserted into the paper-shredder; and an opening and closing unit slidably installed inside the paper-shredder and configured to close the first paper insertion inlet when vacuum-cleaning and open the first paper insertion inlet when using the paper-shredder.

2. The vacuum cleaner as claimed in claim 1, wherein the paper-shredder further comprises a pair of rotation cutters disposed in parallel to be engaged with each other and configured to shred the paper.

3. The vacuum cleaner as claimed in claim 2, wherein the opening and closing unit drives the pair of rotating cutters while opening the first paper insertion inlet.

4. The vacuum cleaner as claimed in claim 3, wherein the paper-shredder further includes a limit switch configured to be turned on or off selectively according to sliding movement of the opening and closing unit.

5. The vacuum cleaner as claimed in claim 3, wherein a sealing member is disposed between a top of the opening and closing unit and an upper inner surface of the paper-shredder and surrounds the first paper insertion inlet.

6. A vacuum cleaner, comprising:

a cleaner body including a suction source configured to generate a suction force;

a suction inlet body configured to inhale dust on a surface to be cleaned using the suction force of the suction source;

a dust bucket detachably installed on the cleaner body and configured to separate the dust from air flowed in from the suction inlet body and collect the dust; and a paper-shredder configured to detachably communicate with an opening of the dust bucket to shred a paper and collect the shredded pieces of paper in the dust bucket, wherein the dust bucket includes an upper cover configured to open and close a top of the dust bucket, the upper cover forms a shredded-paper insertion inlet configured to cause shredded pieces of paper discharged from the paper-shredder to be put in, and the paper-shredder forms a shredded-paper discharge outlet corresponding to the shredded-paper insertion inlet in a lower portion thereof.

7. The vacuum cleaner as claimed in claim 6, wherein sealing members are disposed between the dust bucket and the paper-shredder and configured to prevent external air from flowing in the dust bucket, the sealing members surround peripheries of the shredded-paper insertion inlet and shredded-paper discharge outlet.

8. A vacuum cleaner, comprising:

a cleaner body including a suction source configured to generate a suction force;

a suction inlet body configured to inhale dust on a surface to be cleaned using the suction force of the suction source;

a dust bucket detachably installed on the cleaner body and configured to separate the dust from air flowed in from the suction inlet body and collect the dust; and a paper-shredder configured to detachably communicate with an opening of the dust bucket to shred a paper and collect the shredded pieces of paper in the dust bucket, wherein the cleaner body includes a first limit switch configured to turn on or off the suction source selectively, and the dust bucket includes a push protrusion configured to turn on the first limit switch when the dust bucket is mounted on the cleaner body and turn off the first limit switch when the dust bucket is detached from the cleaner body.

9. The vacuum cleaner as claimed in claim 8, wherein the paper-shredder further includes a second limit switch configured to be turned on or off selectively according to sliding movement of the opening and closing unit, the pair of rotating cutters are operated when both of the first and second limit switches are turned on.

10. A vacuum cleaner, comprising:

a cleaner body including a suction source configured to generate a suction force;

a suction inlet body configured to inhale dust on a surface to be cleaned using the suction force of the suction source;

a dust bucket detachably installed on the cleaner body and configured to separate the dust from air flowed in from the suction inlet body and collect the dust; and a paper-shredder configured to detachably communicate with an opening of the dust bucket to shred a paper and collect the shredded pieces of paper in the dust bucket, wherein the dust bucket communicates with a discharging unit of the paper-shredder to cause the shredded pieces of paper attached to a side of the discharging unit of the paper-shredder to be shaken and separated from the side of the discharging unit of the paper-shredder by cyclonic airflow formed inside the dust bucket and to be collected inside the dust bucket.

11. The vacuum cleaner as claimed in claim 10, wherein the suction source is operated when the paper-shredder is operated.

12. The vacuum cleaner as claimed in claim 10, wherein the dust bucket includes a cyclonic airflow forming space, and a dust collecting space surrounding the cyclonic airflow forming space.

13. The vacuum cleaner a claimed in claim 12, wherein the dust bucket includes an upper cover configured to open and close a top thereof, the upper cover forms the shredded-paper insertion inlet configured to cause the shredded pieces of paper discharged from the paper-shredder to be put in, the dust collecting space communicates with an inside of the paper-shredder through the shredded-paper insertion inlet.

14. The vacuum cleaner as claimed in claim 12, wherein the cyclonic airflow forming space includes an exhaust tube configured to exhaust air separated from the dust outside the dust bucket, and an air turning guide formed substantially in a spiral shape along an outer circumference of the exhaust tube.

15. A vacuum cleaner, comprising:

a cleaner body including a suction source configured to generate a suction force;

a suction inlet body configured to inhale dust on a surface to be cleaned using the suction force of the suction source;

a dust bucket detachably installed on the cleaner body;

a cyclonic unit formed inside the dust bucket and configured to centrifuge the dust from air flowed in through the suction inlet body; and a paper-shredder installed on a top of the dust bucket and configured to communicate with the top of the dust bucket so that shredded pieces of paper are dropped inside a dust collecting space of the dust bucket.

16. The vacuum cleaner as claimed in claim 15, wherein the dust bucket communicates with a discharging unit of the paper-shredder to cause the shredded pieces of paper attached to a side of the discharging unit of the paper-shredder to be shaken and separated from the side of the discharging unit of the paper-shredder by cyclonic airflow formed inside the dust bucket and to be collected inside the dust bucket.

17. The vacuum cleaner as claimed in claim 15, wherein the paper-shredder includes an opening and closing unit configured to selectively open or airtight close an opening thereof, which is configured to allow a paper to be put in, the paper-shredder performs a paper-shredding operation when the opening of the paper-shredding is opened by the opening and closing unit.

18. The vacuum cleaner as claimed in claim 15, wherein the cleaner body includes a first limit switch configured to turn on or off the suction source selectively, the dust bucket includes a push protrusion configured to turn on the first limit switch when the dust bucket is mounted on the cleaner body and turn off the first limit switch when the dust bucket is detached from the cleaner body.

19. The vacuum cleaner as claimed in claim 18, wherein the paper-shredder further includes a second limit switch configured to be turned on or off selectively according to sliding movement of the opening and closing unit so that the paper-shredder selectively performs or stops a paper-shredding operation.

20. The vacuum cleaner as claimed in claim 19, wherein the paper-shredder performs the paper-shredding operation when both of the first and second limit switches are turned on.

* * * * *

UNITED STATES PATENT AND TRADEMARK OFFICE

CERTIFICATE OF CORRECTION

PATENT NO. : 8,857,010 B2
APPLICATION NO. : 13/889728
DATED : October 14, 2014
INVENTOR(S) : Jang-keun Oh et al.

It is certified that error appears in the above-identified patent and that said Letters Patent is hereby corrected as shown below:

Title Page, Item (12) should read:

Oh et al.

Title Page, Column 1 (Inventors), Line 1:

Delete "Jan-Keun Kim," and insert --Jang-Keun Oh,--, therefor.

Title Page, Column 1 (Inventors), Line 3:

Delete "Gwanju (KR);" and insert --Gwangju (KR);--, therefor.

In the Claims

Claim 13, Column 14, Line 1:

Delete "cleaner a" and insert --cleaner as--, therefor.

Signed and Sealed this
Fifteenth Day of September, 2015

Michelle K. Lee

Michelle K. Lee
*Director of the United States Patent and Trademark Office*